United States Patent [19]

Burgert

[11] 4,408,916

[45] Oct. 11, 1983

[54] FEED-IN DEVICE FOR CONTINUOUS FORMS FOR A PRINTER

[76] Inventor: Manfred Burgert, Obere Breitensteinstrasse 16, 8201 Kolbermoor, Fed. Rep. of Germany

[21] Appl. No.: 269,035

[22] PCT Filed: Sep. 18, 1980

[86] PCT No.: PCT/DE80/00135

§ 371 Date: May 13, 1981

§ 102(e) Date: May 13, 1981

[87] PCT Pub. No.: WO81/00830

PCT Pub. Date: Apr. 2, 1981

[30] Foreign Application Priority Data

Sep. 18, 1979 [DE] Fed. Rep. of Germany ..... 2937687

[51] Int. Cl.[3] ..... B41J 15/04; B41J 15/18

[52] U.S. Cl. ..... 400/613.2; 400/617; 400/618; 200/61.18; 226/147

[58] Field of Search ..... 400/605, 609, 618, 617, 400/606, 613.2; 200/61.18; 188/65.1; 226/147-151

[56] References Cited

U.S. PATENT DOCUMENTS

| | | | |
|---|---|---|---|
| 298,541 | 5/1884 | Amet | 188/65.1 |
| 1,610,599 | 12/1926 | Boyd | 400/42 |
| 1,920,640 | 8/1933 | Hano | 400/613.2 |
| 2,587,827 | 3/1952 | Fleischmann | 400/613.2 |
| 2,894,106 | 7/1959 | Jacob et al. | 200/61.18 X |
| 2,973,081 | 2/1961 | Maidment et al. | 400/613.2 |
| 3,586,149 | 6/1971 | Miller | 101/93.28 X |
| 4,087,699 | 5/1978 | Marzoli | 200/61.18 X |

OTHER PUBLICATIONS

Dowd, et al., "Continuous Forms Feed", IBM Technical Disclosure Bulletin, vol. 17, No. 7, Dec. 1974, pp. 1933-1934.

*Primary Examiner*—Clifford D. Crowder
*Attorney, Agent, or Firm*—George E. Kersey

[57] ABSTRACT

A feed in device for continuous forms (e.g. in rolls or stacks) for supplying the printer of a data processing system. The rolls or stacks are arranged one underneath the other or one next to the other. The individual continuous form pages can be pulled off upwards flat next to one another. A guiding device is arranged above the rolls or stacks, where said guiding device is provided with slots for the passage of respectively one continuous form. A holding device is here provided for each slot, which prevents the respective continuous form from sliding downwards.

5 Claims, 2 Drawing Figures

FEED-IN DEVICE FOR CONTINUOUS FORMS FOR A PRINTER

BACKGROUND OF THE INVENTION

The invention concerns a feed-in device for various continuous forms, assembled in rolls or stacks, for feeding the printer of a data processing system. Here, the rolls or stacks are arranged respectively below or next to one another, so that the individual continuous form sheets can be pulled off upwards flat next to one another.

When a data processing system is used for various functions, for example, accounting, scheduling, routine circulars, invoicing, and the like, appropriate preprinted continuous forms are always required. Depending on the work of the data processing system, they are fed as continuous forms for the particular function, into the printer of the data processing system. Consequently, for such an operation, an appropriate number of continuous forms must be kept available, since each function generally requires its own individual printed form. When making a transition from one to another function, it is necessary to remove the continuous form stock that was previously fed into the printer and to insert into the printer the continuous form stock that is required for the new function. The continuous forms are generally assembled in stacks and housed in cartons. Up to now, their interchange has been accomplished by placing them by the printer as required, and by inserting into the printer the continuous form stock from the carton. The cartons which contain the continuous form stock involve objects of considerable weight. Consequently, the replacement of cartons, which is necessary in the well-known operating mode described above, represents a bodily stress for the operating personnel, which impairs the rapid operation of the data processing system and which occasionally cannot be managed at all by the available personnel. In any case, transporting the respective cartons back and forth is tedious work.

Instead of assembling the continuous forms into a stack, there also exists the possibility of assembling them on a roll, which then must be replaced like the above-described carton. The problem of back-and-forth transport is here the same.

A feed-in device for continuous forms assembled in stacks is already known from the U.S. Pat. No. 2,587,827. Here, the continuous forms are conducted to a printer. The feed-in device here consists of a box with compartments arranged vertically or horizontally next to one another, to which the respective stack of continuous forms is assigned. The continuous forms are here either pulled out upwards from the vertical compartments or are pulled out sideways from the horizontal compartments and are conducted to a printer. With this arrangement to transfer from one continuous form to another, it is necessary to reach into the respective compartment, and to seize the end of the continuous form located in this compartment, so as to thread it into the printer. This extraction of a continuous form from a compartment, when transferring from one continuous form to another, represents an inconvenient handling process, especially when a compartment is still nearly completely filled up by the respective stack. In this case, there is only little space for seizing the respective end of the continuous form with the hand.

Furthermore, from the journal IBM Technical Disclosure Bulletin, Volume 17, Number 7, December 1974, pages 1933 and 1934, a feed-in device for continuous forms collected in stacks has become known, which involves the following: When a stack is used up, a new stack is rapidly made available or else a transfer is made from one stack to another stack that has previously been made ready. This particular arrangement works with a rotary device, which has room for two stacks. The continuous form is always withdrawn from one stack, while the second stack is held in readiness on the rotary device. At first, its end is held fast by a spiked roller. If a stack has now been used up, or if the continuous form of the stack held in readiness is to be fed in, the rotary device is turned, and the ready stack is thereby brought into position for pulling off the continuous form. The end of the respective continuous form, which is held fast by the spiked roller, is then tilted over to the feed-in device of the printer, which thereupon pulls in the continuous form.

SUMMARY OF THE INVENTION

The invention is based on the aim of essentially avoiding the back-and-forth transport of rolls and stacks of continuous forms, and of designing the preparation of a multiplicity of continuous forms in such a fashion that the latter can be introduced into the printer quickly in an especially simple manner, especially when a transition is made from one continuous form to another. According to the invention, this aim is achieved by arranging, above the rolls or stacks, a guiding device that is provided with slots, each one designed for the passage of one continuous form. Here, a holding device is provided for each slot, which prevents the particular continuous form from sliding downwards.

The above-described arrangement of the rolls or stacks has as its result that as many continuous form strips extend from the slots of the guiding device as are altogether provided for operating the respective data processing system. The continuous form strips are here retained by the holding device, so that they cannot slide back through the respective slot in the guiding device, after being separated from the printer. When a transition is made from one form sheet to another, the last processed continuous form strip is therefore separated above the holding device, its remainder is taken out from the printer, and the continuous form strip required for the next function is withdrawn from the guiding device and is threaded into the printer. Consequently, the individual continuous form strips are available ready for handling, in the guiding device, always being retained by the holding device. As they are needed, they can be threaded into the printer easily, and especially without moving the particular stack or the particular roll back and forth. This involves work which, on the one hand, can be executed very quickly and, on the other hand, presents practically no strain to the operating personnel. Transportation of a carton or a roll is required only when a stack or a roll of a continuous form has been used up. In this case, a new roll or a new stack must be inserted at the appropriate location. From there, the respective continuous form strip must then be inserted into the guiding device and into the holding device.

In contrast to the arrangement described in the journal IBM Technical Disclosure Bulletin, the feed-in device according to the invention offers the advantage that no motion of the stack or roll is necessary when making a transition from one continuous form to another. As a consequence, the interchange from one continuous form to another can proceed very rapidly, with respect to the arrangement according to the U.S. Pat. No. 2,587,827, the invention provides the advantage that the continuous forms are available with their ends directly ready for handling, so that they can be grasped easily. The continuous forms here always extend somewhat above the guiding device and therefore can also be recognized immediately as regards their characteristics, e.g. type of preprinting.

The guiding device is suitably set into a table, which is connected with the printer, and which in particular may support the printer. In this case, the stacks or rolls are suitably housed underneath the table top. The individual continuous form strips are then conducted to the slots in the guiding device.

The holding device can be designed as an eccentrically mounted shaft, which contacts the wall of the respective slot because of gravity. Here, the continuous form is pulled up along this wall and, as it is pulled off, it presses the shaft away from the wall. In this way, the shaft cannot hinder the withdrawal of the continuous forms. However, the continuous form strip lies between the shaft and the wall and the pressure of the shaft presses the continuous form strip against the wall. As a result, when it happens not to be just then threaded into the printer, it cannot slide back into the guiding device by virtue of its weight. Naturally, the shaft can also be constructed of individual parts per slot, and in particular to two parts at the two edges of the continuous form strip.

The holding device is suitably placed into a slot. As a result, when a table is used and when the guiding device is set into the table, only the ends of the available continuous form strips protrude from the respective table top. From here, they can be individually and easily conducted to the printer by hand.

It is advantageous to provide the holding device with a signal generator that tests the presence of a continuous form. As long as this signal generator indicates the presence of the continuous form, the feed-in device is fully ready to operate. However, if one continuous form has been used up, the signal generator reports this condition. This prevents the printer from perhaps writing on an empty roller. The signal generator can here simultaneously stop the printer when it determines that the continuous form has been exhausted.

It is advantageous to design the shaft of the holding device together with the guiding device as the switching contact that forms the signal generator. If the end of a continuous form strip is then pulled through the holding device, the shaft then makes contact with the wall of the respective slot of the guiding device and closes the contact. In order to fulfill this contacting function, the shaft can be mounted so as to be electrically insulated, and the wall of the respective slot can be placed at an appropriate electrical potential. Naturally, however, it is also possible to provide a special insulated contact pin in the wall.

DESCRIPTION OF THE DRAWINGS

The figures show an embodiment of the invention. The following are shown.

DETAILED DESCRIPTION

Figure 1:
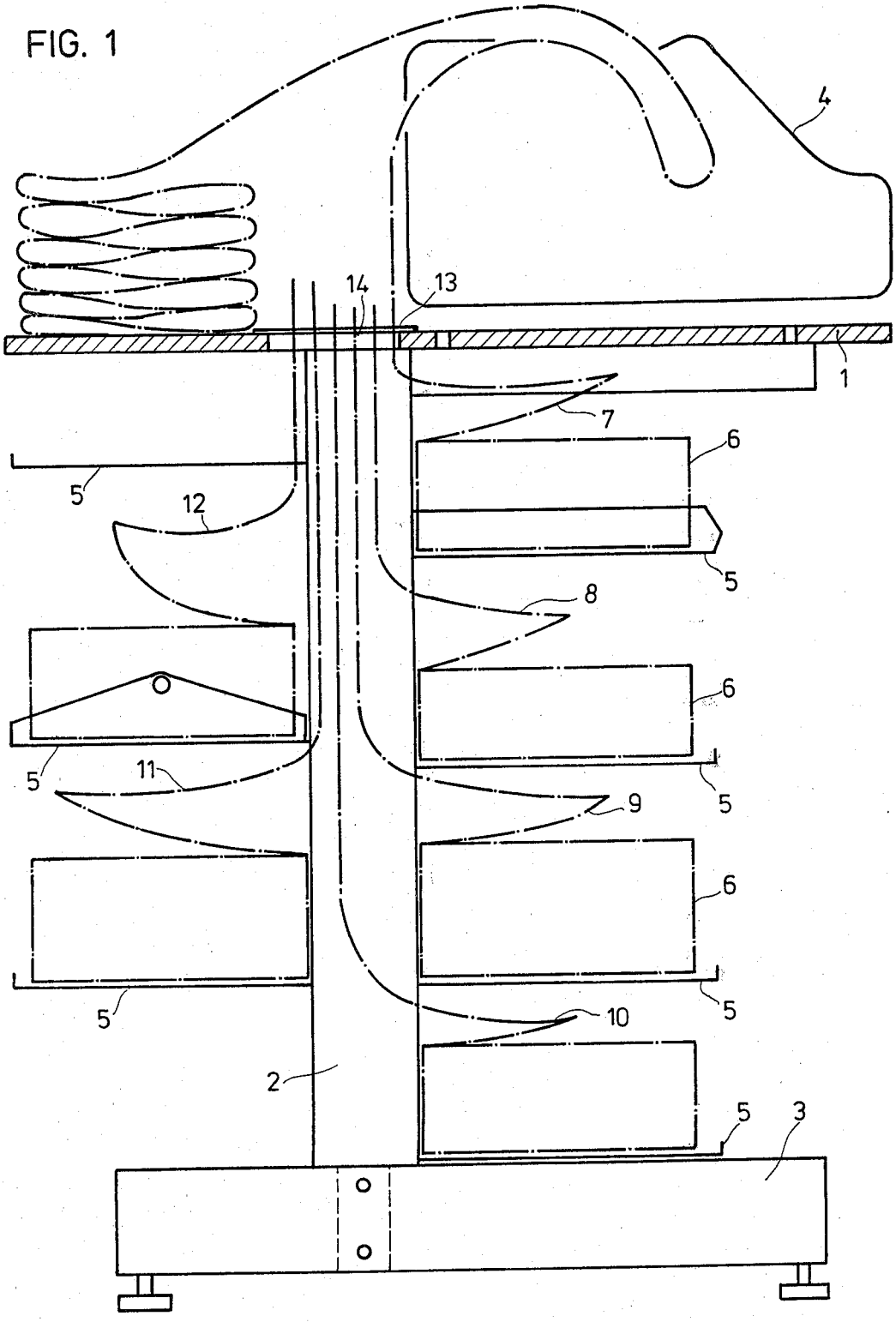
FIG. 1 shows a section through a table with a printer supported thereon, and cartons arranged underneath the table top.

FIG. 1 shows a table with a table top 1, a support 2, and a foot 3. The printer 4 of a data processing system, here designed as a kind of teletype, is situated on the table top 1. Below the table top 1, at the support 2, the consoles 5 are arranged laterally. On these are placed the cartons 6 with the continuous form strips 7, 8, 9, 10, 11 and 12. For the operating case being considered here, one of the consoles 5 has remained empty. The continuous form strips 7 are assembled in the cartons 6 as stacks of fan-folded continuous form strips.

The continuous form strips 7–12 are individually guided upwards next to the support 2, at first underneath the table top 1. In particular, this is done so that their flat sides face one another in parallel one next to the other. In this relative position, the continuous form strips 7–12 are threaded through the guiding device 13, which is set into the table top 1. For this purpose, the guiding device 13 is equipped with corresponding slots 14. Holding devices, which are not shown here, are provided in the slots 14. These holding devices will be discussed in more detail in connection with FIG. 2. The continuous form strips 7–12 then extend a few centimeters above the guiding device 13, unless they are threaded into the printer 4. In this way, they are always available ready for reach. In the operating case under consideration, the continuous form strip 7 has been threaded into the printer, runs through the printer in well-known fashion, and is then again lead out of the printer. It is stored behind the printer 4 on that part of table top 1 that has been provided for this purpose. It is therefore suitable to provide a table top 1 that has a size appropriate for the intended operation.

When the particular data processing system, which is not shown and which works together with the printer 4, now must transfer to another function, the continuous form strip 7, which is threaded into the printer 4, is separated above the guiding device 13 along a tear-off point, the remainder of the continuous form strip is withdrawn from the printer 4, and the continuous form strip required for the next function, for example the continuous form strip 8, is pulled through the guiding device 13 and is threaded into the printer 4, which thereupon can write on this continuous form strip. The transition from one continuous form strip to another is therefore quite simple and is not associated with any motion of the cartons 8. In the embodiment under consideration, these cartons are furthermore stored in a space-saving fashion underneath the table top 1.

Figure 2:
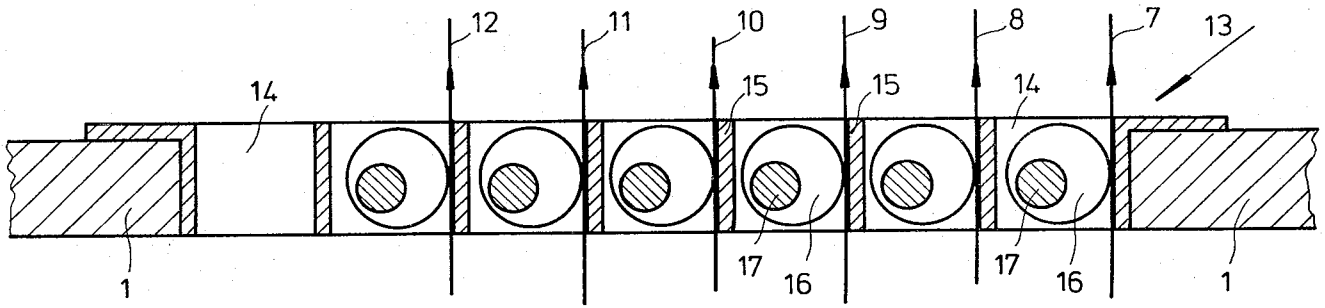
FIG. 2 shows a section through the guiding device with holding devices arranged in the slots.

FIG. 2 shows the guiding device 13 in section. It is set into the table top 1 and has slots 14, which are separated from one another by the walls 15. The shafts 16 are mounted in the slots 14 and in particular on eccentric axles 17. As a result of the inherent weight of the shaft 16, there is a trend for the shaft 16 to contact the respective right side of the relevant slot 14 under the action of gravity. The continuous form strips 7 through 12 are now pulled through here. Under the above-described action of the shafts 16, they are pressed against the respective wall of the slot 14. This mode of procedure prevents the continuous form strips 7–12, which have been cut off above the guiding device 13, from being able to slide back through the slots 14 because of their weight. However, the shafts 16, which here form the holding device, equally allow the continuous form strips 7–12 to be pulled out upwards from the guiding device, in the direction of the drawn-in arrows, since here the shafts 16 lift slightly from the respective walls of the slots 14.

In order to indicate to the relevant data processing system that a continuous form strip has been used up, the shafts 16 together with the respective walls 15 form a switching contact. When a shaft 16 contacts the respective wall of the slot 14, the contact is closed. For this purpose, the shafts 16 are mounted in an insulated fashion, and consist of metal, as does the guiding device 13. The shafts 16 and the respective walls 15 form a switching contact. When this switching contact is closed, an electrical signal is triggered. In a manner that is not of interest here, this signal indicates that the respective continuous form strip has been used up. The data processing system can thereby also be stopped at the same time.

While various aspects of the invention have been set forth by the drawings and specification, it is to be understood that the foregoing detailed description is for illustration only, and that various changes in parts, as well as the substitution of equivalent constitutents for those shown and described may be made without departing from the spirit and scope of the invention ad set forth in the appended claims.

What is claimed is:

1. Apparatus for the feed of continuously connected form strips to a printing device, comprising means for guiding said strips to said printing device, means for positioning said strips below the guiding means, and means included in said guiding means for individually retaining a plurality of said strips extending vertically through and terminating above said guiding means, said strips being from separate sources, and held in position for being grasped individually by a user for subsequent feed to said printing device.

2. Apparatus as defined in claim 1 wherein the retaining means comprises a separate slot for the strips of each separate source and each slot includes an eccentrically mounted cam which is positioned against a wall of said slot when the strip is absent therefrom and temporarily holds said strip against said wall by the action of gravity when the strip is introduced into said slot.

3. Apparatus as defined in claim 1 wherein the retaining means includes means for detecting the presence of a continuously connected form strip held thereby.

4. Apparatus as defined in claim 3 wherein the retaining means acts as a switching contact through which an indicator is energizable.

5. The method of providing for the continuous feed of continuously connected form strips to a printing device comprising the steps of:

(a) feeding one continuously connected form strip to a printing device;

(b) temporarily holding another continuously connected form strip extending vertically with the end thereof protruding above a temporary holding mechanism;

(c) grasping said end of the other strip and pulling to release it from its temporary hold position and feeding said end into said printing device at the termination of feed of said one strip.

* * * * *